US007900586B2

(12) United States Patent
Hamblen

(10) Patent No.: US 7,900,586 B2
(45) Date of Patent: Mar. 8, 2011

(54) TETHER FOR USE WITH AUTISTIC CHILDREN

(76) Inventor: Eric J. Hamblen, Beaverton, OR (US)

( * ) Notice: Subject to any disclaimer, the term of this patent is extended or adjusted under 35 U.S.C. 154(b) by 100 days.

(21) Appl. No.: 12/283,117

(22) Filed: Sep. 10, 2008

(65) Prior Publication Data

US 2010/0058996 A1 Mar. 11, 2010

(51) Int. Cl.
*A62B 35/00* (2006.01)

(52) U.S. Cl. ..... 119/770; 119/857

(58) Field of Classification Search ..... 119/770, 119/857, 792; 482/124; 2/338, 920
See application file for complete search history.

(56) References Cited

U.S. PATENT DOCUMENTS 3,458,188 A * 7/1969 Infante ..... 472/133
4,214,382 A * 7/1980 Matsutani ..... 434/247
4,273,215 A * 6/1981 Leggett ..... 182/3
4,424,040 A * 1/1984 Buchheister et al. ..... 434/253
4,445,866 A * 5/1984 Cillieres ..... 434/253
4,667,624 A * 5/1987 Smith ..... 119/770
4,751,896 A * 6/1988 Miley ..... 119/770
5,029,434 A * 7/1991 Erickson ..... 54/44.1
5,158,510 A * 10/1992 Lemire ..... 482/51
5,423,292 A * 6/1995 Hall ..... 119/770
5,638,772 A * 6/1997 Kaufmann et al. ..... 119/770
D383,256 S * 9/1997 Hampton ..... D30/153
5,664,639 A * 9/1997 Worth ..... 182/3
5,718,189 A * 2/1998 Blake ..... 119/770
5,746,672 A * 5/1998 Smith ..... 473/464
5,842,444 A * 12/1998 Perrulli ..... 119/770
5,901,531 A * 5/1999 Rogers ..... 54/44.1
5,950,569 A * 9/1999 Perrulli ..... 119/770
5,951,443 A * 9/1999 Askins ..... 482/74
6,047,665 A * 4/2000 Deveaux ..... 119/770
6,095,093 A * 8/2000 Kisko et al. ..... 119/770
6,422,176 B1 * 7/2002 Tonuzi ..... 119/770
6,427,374 B1 * 8/2002 Vaiani ..... 42/85
6,449,815 B1 * 9/2002 Spiller ..... 24/306
6,553,944 B1 * 4/2003 Allen et al. ..... 119/769
6,651,594 B1 * 11/2003 Bagwell ..... 119/770
6,851,393 B2 * 2/2005 Bremm ..... 119/770
6,990,928 B2 * 1/2006 Kurtgis ..... 119/770
7,017,525 B2 * 3/2006 Leach ..... 119/770
7,228,678 B2 * 6/2007 Wilson ..... 54/44.1
7,284,505 B1 * 10/2007 Paxton et al. ..... 119/792
7,384,382 B2 * 6/2008 Farrah et al. ..... 482/124
7,467,604 B1 * 12/2008 Werner et al. ..... 119/770
7,516,717 B2 * 4/2009 David et al. ..... 119/770
2005/0229867 A1 * 10/2005 Green ..... 119/770
2008/0282994 A1 * 11/2008 Martin ..... 119/795
2009/0118107 A1 * 5/2009 Prstojevich et al. ..... 482/124
2009/0194038 A1 * 8/2009 Burgett ..... 119/770
2009/0235873 A1 * 9/2009 Gould et al. ..... 119/770

* cited by examiner

*Primary Examiner* — Yvonne R. Abbott
(74) *Attorney, Agent, or Firm* — James D. Givnan, Jr.

(57) ABSTRACT

A tether for use with autistic children includes belts, one each for wear by an adult and a child for maintaining them side by side during a training session. Tether attached rings are confined by fabric closure members on the belts to maintain proximity of child and adult but can yield upon increased tensioning of the tether. The tether has spaced loops for adjusting tether length. A lock is provided to secure a tether end.

1 Claim, 2 Drawing Sheets

17A
24
22
23
21
17
15
18
20
19
14
14
15
16
5
4
5
7
14
14
11
12
7
10
13
6

21
17
24
23
22
17A
15
15
16
5
4
18
20
19
14
14
4
5
14
7
25
10
11
7A
6

5
4
7
14
14
11
12
7
10
13
6

TETHER FOR USE WITH AUTISTIC CHILDREN

BACKGROUND OF THE INVENTION

The present invention pertains generally to a device for assisting disabled children diagnosed as being autistic.

Such children are introverted to the extreme and may be helped by persons trained in promoting conversation with the child.

It has been determined that such interchanges can be fostered by mutual casual conversations about random objects viewed during a walk in an area of interest such as a park, garden, zoo, etc. Such conversations are promoted by the proximity of the adult and the autistic person and hindered by the separation of same.

U.S. Pat. No. 6,675,742 shows a leash with a series of grommets selectively receiving end mounted snaps to vary the effective length of the leash.

U.S. Pat. No. 4,667,624 discloses a harness to join an adult and child with an adjustable strap. Both have a waistband with snap hooks for attachment to the adult's waistband and to a harness on the child.

BRIEF SUMMARY OF THE INVENTION

The invention is disclosed as including a tether between at least two persons. The tether is provided with a release feature permitting the autistic person to experience separation loss of association and hence loss of a conversation with the adult. Reestablishment of the tether connection appears to have a positive effect on the desire to communicate or resume the earlier side by side relationship.

The term child is used presently to identify a person experiencing autism, usually a person of pre-adult age.

A release feature of the tether is responsive to tensioning with tether separation occurring, after opening of a fabric closure component. The gradual displacement of a tether a tether attached ring provides an audible indication, to the child, of impending detachment from the adult. A secondary release provides increased, retention of a tether D-ring when required.

DETAILED DESCRIPTION OF THE INVENTION

Figure 1:
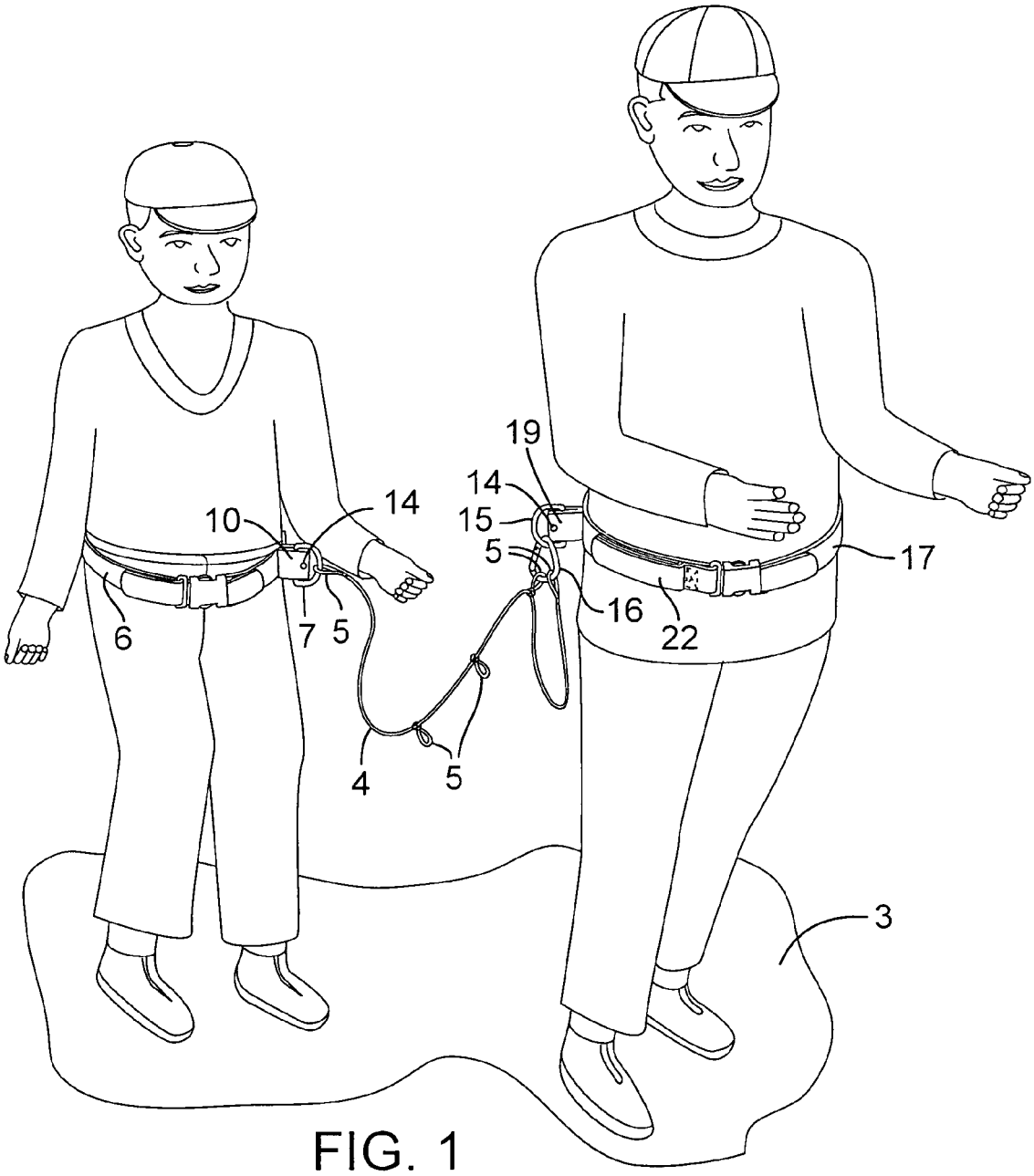
FIG. 1 is a view of the tether in use.

With continuing reference to the drawing wherein reference numerals identify parts hereafter similarly identified, numerals 1 and 2 indicate respectively an adult, preferably knowledgeable about autism, and an autistic person.

An area at 3 could be a park, yard, trail, etc., having objects of interest about which both parties would likely comment upon or discuss.

A tether at 4 is a cord a few feet in length preferably provided with spaced loops 5 for varying tether length.

Figures 2, 3, 4:
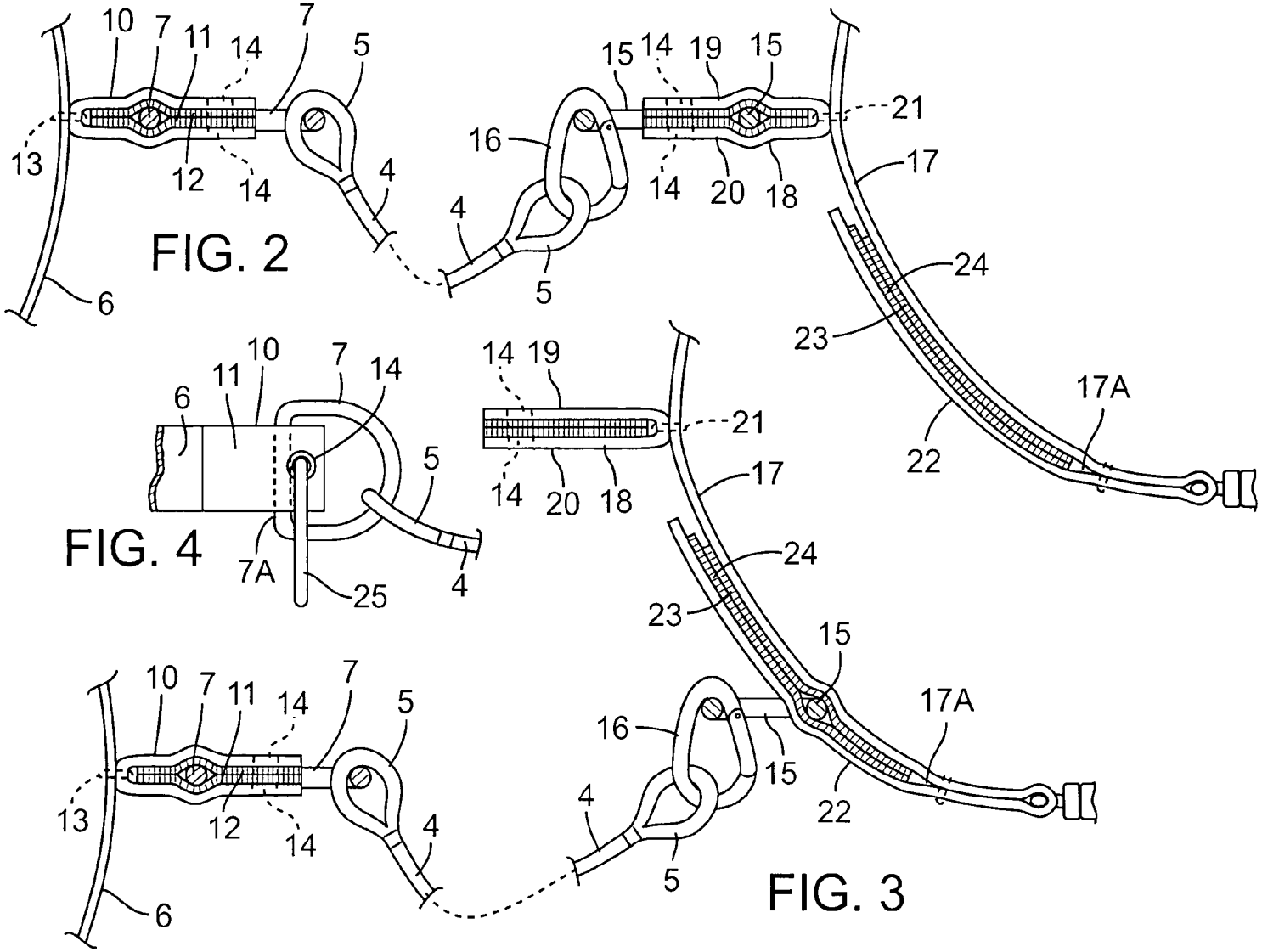
FIG. 2 is a fragmentary plan view of the tether.
FIG. 3 is a fragmentary plan as a modified tether.
FIG. 4 is an elevational view of a retainer on a belt fragment.

The autistic person at 2 is provided with a belt 6 to receive one end of the tether by means of a ring 7, which may be a D-ring. A retainer 10 for the tether ring includes a fabric closure with hook and loop components 11 and 12 suitably affixed to belt 6 as by stitching 13. Ring 7 has a segment 7A in FIG. 4 extending beyond the upright width of the components 11 and 12, and is retained against movement by the action of the joined hook and loop components. Suitable closure material is marketed under the trademark VELCRO by the 3M Corporation.

If desired a lock may be provided to prevent separation of ring 7 from retainer 10. Grommets at 14 in each component 11 and 12 are in alignment to receive the lock such as a carabiner 25.

The travel of ring 7 between retainer components and toward separation is in response to tensioning of tether 4, which is audible and indicates to the child that separation with the adult may occur. Assuming the relationship is favorable, the child will likely attempt to prevent separation and retain the side by side relationship.

Tether 4 terminates at its remaining end in attachment to a ring 15, as by a carabiner 16, to the adult's belt at 17. A retainer 18 includes hook and loop components at 19 and 20 stitched at 21 to belt 17.

In use, the belts are applied to the parties with the rings disposed toward one another with the tether being inconspicuous. The adult will initiate a conversation based on observations made during their walk. The foregoing is a very brief description of the tethers use with but one technique provided as an example.

A secondary or optional retainer at 22 includes fabric closure components 23 and 24 respectively on adult belt segments 17-17A. Ring 15, in response to periodic tensioning of tether 4, must travel the length of closure components 23 and 24 for release.

While I have shown but a few embodiments of the tether, it will be apparent to those skilled in the art that the invention may be embodied still otherwise without departing from the spirit and scope of the claimed invention.

I claim:

1. A device for keeping two persons proximate and including, first and second belts for wear respectively by two persons, a tether extending between said belts, retainers attaching said tether to the first and second belts and at least one of said retainers including a fabric closure with hook and loop components, and a ring on said tether normally confined in the fabric closure against all but intentional tensioning of the tether, said hook and loop components include grommets for reception of a lock to prevent ring extraction from the fabric closure.

* * * * *